US005984106A

United States Patent [19]

Uwa

[11] Patent Number: 5,984,106

[45] Date of Patent: Nov. 16, 1999

[54] MACHINE FOR SORTING SOLID OBJECTS

[75] Inventor: Marian Uwa, Kremperheide, Germany

[73] Assignee: Magotteaux International, Vaux-Sous-Chevremont, Belgium

[21] Appl. No.: 08/913,201

[22] PCT Filed: Apr. 4, 1996

[86] PCT No.: PCT/EP96/01483

§ 371 Date: Sep. 3, 1997

§ 102(e) Date: Sep. 3, 1997

[87] PCT Pub. No.: WO96/34702

PCT Pub. Date: Nov. 7, 1996

[30] Foreign Application Priority Data

May 5, 1995 [EP] European Pat. Off. ..... 95106834

[51] Int. Cl.[6] ..... B07B 1/22

[52] U.S. Cl. ..... 209/288; 209/290

[58] Field of Search ..... 209/289, 290, 209/284, 288, 293

[56] References Cited

U.S. PATENT DOCUMENTS

| | | | |
|---|---|---|---|
| 107,994 | 10/1870 | Allonas | 209/290 X |
| 182,693 | 9/1876 | Neuerburg | 209/290 |
| 772,331 | 10/1904 | Baxter | 209/290 X |
| 1,617,688 | 2/1927 | Toole | 209/290 X |

*Primary Examiner*—William E. Terrell
*Assistant Examiner*—Gene O. Crawford
*Attorney, Agent, or Firm*—Schmeiser, Olsen & Watts

[57] ABSTRACT

The machine includes a modular rotary drum (10) consisting of various individual sections (10*a*, 10*b*, 10*c*, 10*d*, 10*e*) each having a frustoconical shape converging in the direction of progression of the objects to be sorted. The walls of the various sections are riddled with calibrated sorting holes (26) the size of which increases from the inlet towards the outlet. The interior walls of the various sections are fitted with plates describing a spiral which guides the charge to be sorted, as it progresses. Each sorting hole (26) is in the form of an elongate slot widening in the direction of progression.

8 Claims, 2 Drawing Sheets

MACHINE FOR SORTING SOLID OBJECTS

The present invention relates to a machine for sorting solid objects comprising a horizontal or slightly inclined rotary drum through which the objects to be sorted pass longitudinally and the wall of which is riddled with calibrated sorting holes, in which machine the drum consists, in the longitudinal direction, of various sections, the size of the sorting holes increasing from one section to the next in the direction of progression of the objects to be sorted.

Although not being limited thereto, the invention more specifically targets a machine for sorting the grinding bodies which form the grinding charge of a horizontal mill, such as those used in cement making or in the mining industry for grinding and crushing ores.

It is well known that the composition of the grinding charge, that is to say the quantity, the size of the grinding bodies and their distribution greatly influences the yield and quality of the grinding.

The wear of the grinding bodies constantly alters the ideal starting conditions throughout the service life, and this is why it is attractive to be able rapidly to sort the grinding charge in order to allow it to be returned to optimum conditions.

It is envisageable to carry out this sorting operation frequently only if it can be done quickly, without increasing the normal down-time of the mill.

The consequence of this is that the sorting machine has to have a high sort rate.

Various types of machines for sorting the grinding bodies are known. The machine described in document BE-834187 essentially includes two cylinders which are slightly inclined with respect to the horizontal and which define between them a sorting slot the width of which increases from one side to the other. These two cylinders turn in opposite direction, each turning outwards. The grinding bodies are tipped out into the sorting slot on the minimum width side thereof. The bodies progress under the effect of the rotation and of the inclination of the cylinders and drop through the slot into various collecting hoppers as soon as the width of the slot exceeds the minimum cross-section of a body to be sorted.

This machine gives good sorting provided that the grinding bodies progress in a string one at a time along the cylinders. Under these conditions, the sorting rate is, however, very low.

Another machine is the one described in the preamble and which forms the subject-matter of French Patent Application No. 2248884. The shape of the sorting holes generally corresponds to that of the grinding bodies. To favour the longitudinal movement of the bodies to be sorted the drum is preferably inclined upwards in the direction of progression. As the bodies to be sorted advance through the drum and find a passage larger than their minimum cross-section they pass through this sorting hole to drop into a collecting hopper placed under the drum.

This machine suffers from the handicap that the bodies to be sorted easily become jammed in the sorting holes which thus become obstructed, a phenomenon which not only reduces the surface-area for sorting and therefore the rate but also reduces the sorting accuracy because the bodies to be sorted progress too rapidly towards the outlet since the holes of their size are obstructed.

The object of the present invention is to provide an improved sorting machine which does not have the aforementioned drawbacks; in other words a machine which is endowed with good sorting accuracy and which operates at a high sorting rate.

In order to achieve this objective, the invention proposes a sorting machine of the kind defined in the preamble which is characterized in that each section includes a frustoconical wall converging in the direction of progression of the objects and in that the sorting holes are in the form of slots which widen in the direction of progression through the drum.

The fact that the various sections have a frustoconical profile contributes to favouring the grading of the grinding bodies in superimposed layers, the large bodies as a preference occupying the upper layers and the smaller ones lying along the walls, which makes them easier to remove first of all through the calibrated holes. The effect of this arrangement is that of considerably increasing the effectiveness of the sort.

The fact that the sorting slots widen in the direction of the outlet not only makes it possible to determine the range of dimensions to be sorted but, and above all, prevents objects from becoming blocked in the sorting holes and thereby prevents these holes from being obstructed.

The drum is advantageously a modular drum, in which each section is an independent unit fixed removably to the adjacent section.

Each section may include, at each of its ends, an annular flange so as to be bolted to the adjacent flange of the neighbouring section.

At least the two outermost flanges at the inlet and at the outlet of the drum may be designed as a support and running surface and may be borne by support and running rollers.

According to another aspect of the invention, the walls of the sorting holes are chamfered and diverge from the inside outwards in the direction in which the objects pass through the sorting holes.

These sorting holes are preferably inclined with respect to the direction of progression.

According to another very important aspect of the invention, guide plates are fixed inside each of the sections, more or less perpendicular to the wall and describing a spiral at an angle which varies with the diameter of the bodies to be sorted so as to guide the objects in the direction of their progression.

The machine also includes a tip-out hopper divided into compartments stretching along the entire length of the drum, underneath it.

Other specific features of the invention will become clear from the detailed description of one advantageous embodiment given hereinbelow by way of illustrative example with reference to the appended drawings in which:

FIG. 1 diagrammatically shows a side view of a sorting drum;

Figure 4:
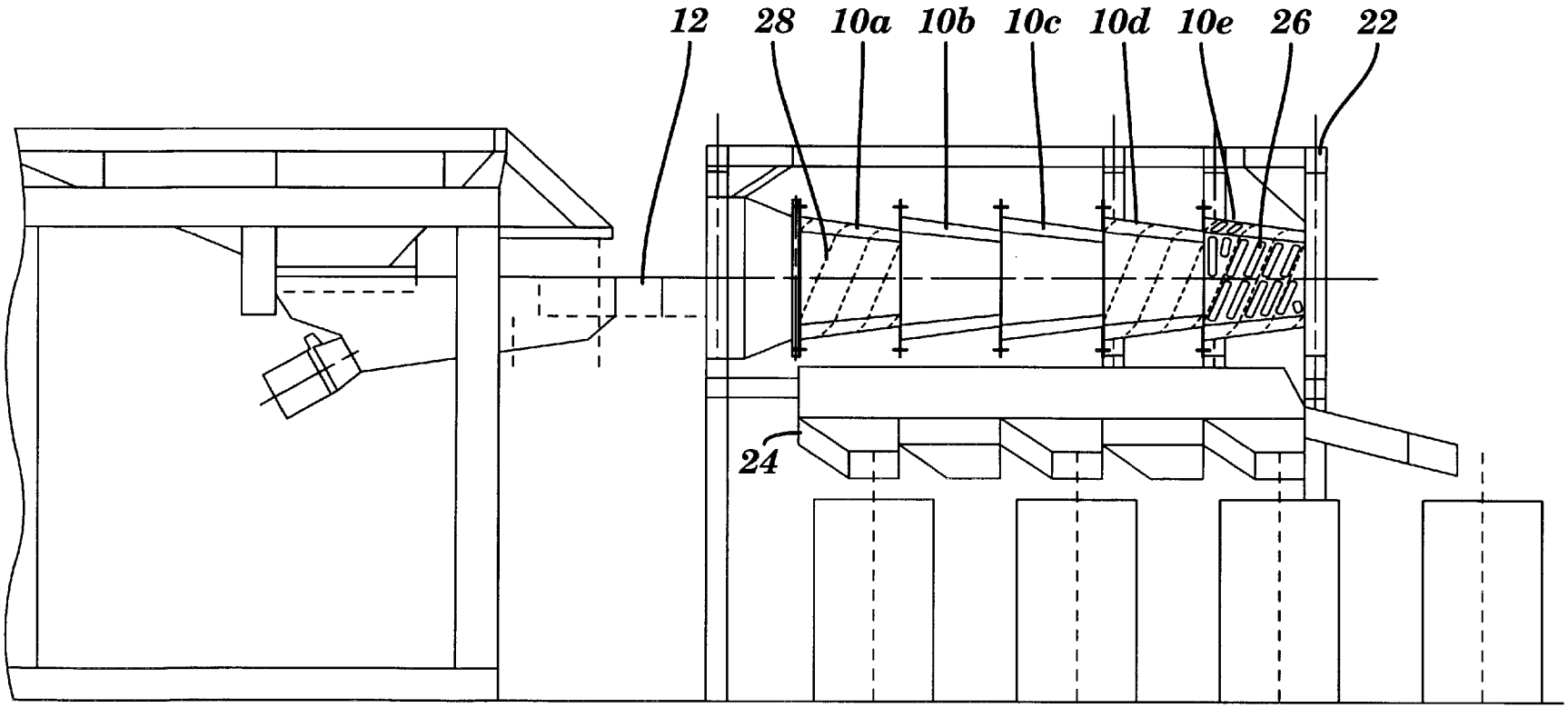

FIG. 4 diagrammatically shows a view of a sorting machine according to the present invention.

Figure 1:
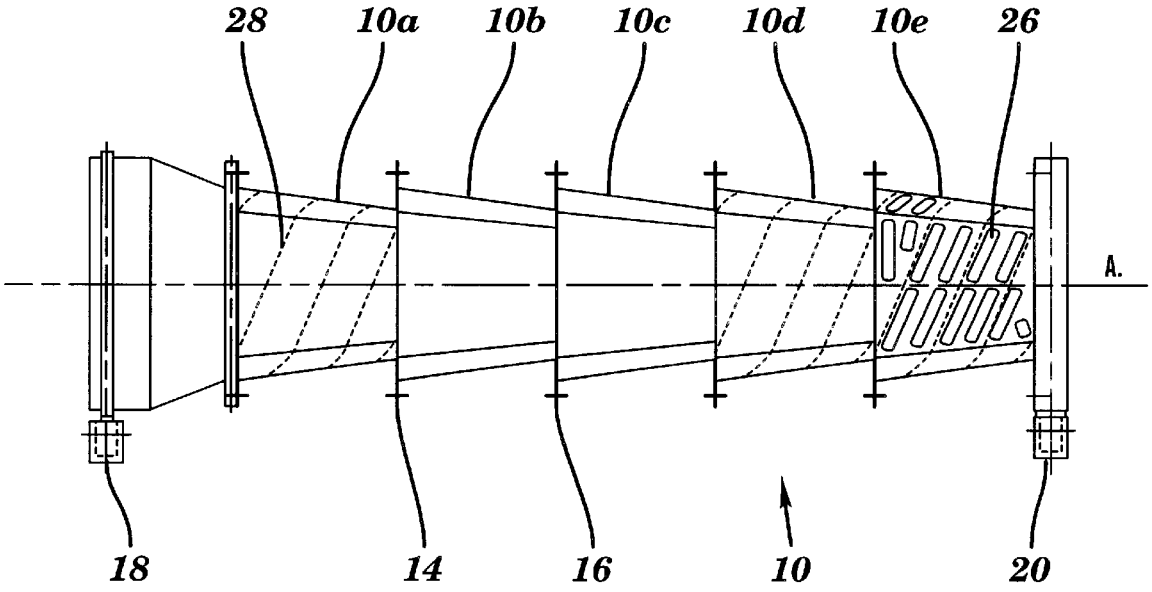

The sorting drum represented in FIGS. 1 and 4 and denoted overall by the reference 10 is made up of various, in this case five, sections 10*a*, 10*b*, 10*c*, 10*d* and 10*e* joined together and through which the bodies to be sorted pass axially.

The drum is theoretically arranged horizontally but, depending on the operating conditions, could be slightly inclined to one side or the other. Each section has a frustoconical wall converging in the direction of progression of the bodies to be sorted, these being introduced into the section 10*a* with the aid of an appropriate feed device 12 (see FIG. 4), for example a vibrating through.

Each frustoconical section may include, on the upstream side and on the downstream side, an annular flange 14 and 16 respectively, via which flanges the section is bolted to the adjacent section. The various sections may thus be replaced individually or even interchanged.

The drum 10 rests via its ends on rollers 18 and 20 and is driven in rotation about its longitudinal axis by a variable-speed motor, not represented. This speed may be adapted to suit the sorting conditions so as to have an influence over the sorting accuracy and sorting rate.

If it proves necessary to do so, it is possible also to provide a roller-type support in the middle region of the drum 10.

The drum 10 may be situated inside a chassis 22 (see FIG. 4) which may be closed in to reduce the emission of noise and allow a dust-removal system to be produced. Underneath the drum 10 there is a tip-out hopper 24 divided into compartments which has a number of compartments corresponding to the number of sections.

The walls of the various frustoconical sections 10*a*, 10*b*, 10*c*, 10*d* and 10*e* are riddled with calibrated sorting holes 26. For reasons of simplification, the sorting holes have been represented in FIGS. 1 and 4 only on the last section 10*e*. The holes of one and the same section preferably all have the same shape and the same surface-area. By contrast, the surface-area of the sorting holes 26 increases from one section to the next in the direction of progression of the charge to be sorted.

According to one of the specific features of the invention, the sorting holes 26 have the shape of an elongate slot, the longitudinal axis of which is inclined with respect to the axis A of the drum and with respect to a diametral plane thereof.

Figure 2:
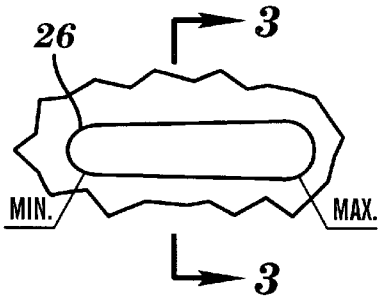
FIG. 2 shows the details of a sorting hole.

As FIG. 2 shows, each sorting hole is furthermore teardrop shaped, that is to say that the width of the sorting holes increases in the direction of progression of the charge to be sorted. The opposite ends of the sorting holes 26 are preferably rounded.

Figure 3:
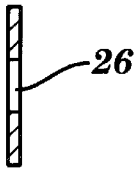
FIG. 3 shows a section on the sectioning plane III—III of FIG. 2.

The walls defining the holes 26 are not perpendicular to the surface but, as FIG. 3 shows, slant slightly, diverging from the inside of the drum outwards. This shape ensures that the bodies to be sorted do not remain jammed in the holes 26 once the interior edge of the holes 26 has allowed the bodies to pass.

Arranged inside each section are guide plates 28 (see FIGS. 1 and 4). These plates 28, the height of which depends on the dimension of the bodies to be sorted, are inclined in a spiral so as to favour and control the progression of the charge as the drum rotates. These plates 28 therefore have a great influence over the sorting accuracy as well as over the throughput of the machine. The inclination of the guide plates 28 preferably corresponds to that of the sorting holes 26 so that the latter are obscured as little as possible by the plates 28.

The first section 10*a* which receives the charge to be sorted via the feed device 12 is theoretically a charge feed and spreading compartment. The second section may serve to remove the bodies which have become too small and cannot be used any longer, as well as any foreign matter and residue of the material to be ground brought in by the charge. It is, however, possible for all these functions to be fulfilled by the first section 10*a*.

The next drums do the actual sorting of the grinding bodies into classes of dimensions and in increasing order from the inlet towards the outlet. Assuming that the size of the sorting holes 26 increases progressively through sections 10*c*, 10*d* and 10*e*, it is possible to sort four different sizes of grinding body, namely the three sizes sorted respectively by sections 10*c*, 10*d* and 10*e*, as well as the large sizes which leave the machine at the outlet.

Given that the various sections are interchangeable, it is possible to duplicate one section, depending on the charge to be sorted. It should also be noted that the choice of five sections is merely one embodiment and that it is perfectly possible to increase or to reduce the number of sections as need be. The machine is therefore endowed with great flexibility for modification.

Bearing in mind the specific shape of the holes, the rows of holes may be arranged in a staggered configuration with respect to one another which increases the number of holes as well as the surface-area for sorting.

I claim:

1. A device for sorting solid objects, comprising:

a) a rotary drum through which the solid objects to be sorted pass, wherein the rotary drum includes a plurality of sections, and wherein each section includes a frustoconical wall that converges in a direction of progression of the solid objects to be sorted; and b) a plurality of sorting holes positioned along the frustoconical wall of each section, wherein the sorting holes increase in size in the direction of progression of the objects to be sorted, and wherein each sorting hole has a first end and a second end, wherein the first end is greater in width than the second end.

2. The device of claim 1, further comprising a tip-out hopper disposed along an entire length of the rotary drum.

3. The device of claim 1, wherein the sorting holes diverge from an inner surface thereof toward a direction in which the solid objects pass through the holes.

4. The device of claim 1, wherein the sorting holes are inclined with respect to the direction of progression.

5. The device of claim 1, wherein each section includes opposing ends each having a flange coupled thereto.

6. The device of claim 1, wherein each section is removably coupled to an adjacent section.

7. The device of claim 1, further comprising guide plates fixed inside each section.

8. The device of claim 7, wherein the guide plates are inclined in a spiral for guiding the solid objects in the direction of progression.

* * * * *